US006246974B1

(12) United States Patent
Jelley et al.

(10) Patent No.: US 6,246,974 B1
(45) Date of Patent: Jun. 12, 2001

(54) METHOD OF DETERMINING CHARACTERISTICS OF A ROTARY DRAG-TYPE DRILL BIT

(75) Inventors: David John Jelley, Cheltenham; Nigel Shaun Wilcox, Bristol, both of (GB)

(73) Assignee: Camco International (UK) Limited, Stonehouse (GB)

( * ) Notice: Subject to any disclaimer, the term of this patent is extended or adjusted under 35 U.S.C. 154(b) by 0 days.

(21) Appl. No.: 09/160,282

(22) Filed: Sep. 24, 1998

(51) Int. Cl.[7] ..... G06G 7/48

(52) U.S. Cl. ..... 703/7; 703/1; 706/929; 702/9

(58) Field of Search ..... 703/1, 7; 706/911, 706/912, 929; 702/9

(56) References Cited

U.S. PATENT DOCUMENTS

| | | | | |
|---|---|---|---|---|
| 4,475,606 | | 10/1984 | Crow . | |
| 5,010,789 | | 4/1991 | Brett et al. . | |
| 5,042,596 | | 8/1991 | Brett et al. . | |
| 5,099,929 | | 3/1992 | Keith et al. . | |
| 5,131,478 | | 7/1992 | Brett et al. . | |
| 5,238,075 | * | 8/1993 | Keith et al. | 175/431 |
| 5,592,996 | * | 1/1997 | Keith et al. | 175/431 |
| 5,607,024 | * | 3/1997 | Keith et al. | 175/431 |
| 5,613,093 | * | 3/1997 | Kolb | 703/1 |
| 5,787,022 | * | 7/1998 | Tibbitts et al. | 703/7 |
| 5,937,958 | * | 8/1999 | Mensa-Wilmot et al. | 175/398 |
| 6,095,262 | * | 8/2000 | Chen | 175/57 |

FOREIGN PATENT DOCUMENTS

| | | |
|---|---|---|
| 0 384 734 | 8/1990 | (EP) . |
| 2 241 266 | 8/1991 | (GB) . |

OTHER PUBLICATIONS

Chinnam, R. B., "On–Line Reliability Estimation of Individual Comonents, Using Degradation Signals", IEEE Transactions on Reliability, vol. 48, Issue 4, pp. 403–412, Dec. 1999.*

Stock, M. "Discussion of Stress Distributions in Rock Drill Heads", International Journal of Machine Tools & Manufacture, vol. 35, Issue 9, pp. 1241–1250, Sep. 1995.*

J. D. Barr, "Optimisation of Radial Distribution of Stratapax (TI) Cutters in Rock Drilling Bits" Paper presented at the Energy–sources Technology Conference, New Orleans, LA, Feb. 1, 1980 A.S.M.E. Petroleum Division.

* cited by examiner

*Primary Examiner*—Kevin J. Teska
*Assistant Examiner*—Douglas W. Sergent
(74) *Attorney, Agent, or Firm*—Jeffery E. Daly

(57) ABSTRACT

A method of determining characteristics of a rotary drag-type drill bit comprises the steps of: creating a computerized representation of the cutters on the drill bit, and then, with each cutter in turn, projecting the shape of the cutter onto a fixed plane having an array of cells, and assigning a first marker to those cells of the array which overlie the projection of the selected cutter. The representations of the other cutters are then rotated about the bit axis until they have all passed through the plane at least once, the cutters also being moved axially while being rotated so as to represent the axial movement of the bit during drilling. The shapes of the other cutters are projected onto the plane, as they pass through it, and a second marker is assigned to those cells of the array which overlie both the projection of the selected cutter and the projections of any of the other cutters. The area, or one or more other parameters, of the region of the array which remains defined by cells having only said first marker is then determined; and there is then estimated, from the parameter or parameters, the forces which will act at the location of the selected cutter in an actual drill bit. The process is repeated for all the cutters on the bit.

40 Claims, 2 Drawing Sheets

METHOD OF DETERMINING CHARACTERISTICS OF A ROTARY DRAG-TYPE DRILL BIT

BACKGROUND OF THE INVENTION

1. Field of the Invention

The Invention relates to rotary drag-type drill bits for use in drilling holes in subsurface formations. In particular, the invention is a method for determining operating characteristics of a rotary drag-type drill bit due to forces acting on its cutting elements.

2. Description of Related Art

The invention is particularly, but not exclusively, applicable to drill bits in which some or all of the cutters are preform cutters formed, at least in part, from polycrystalline diamond or other superhard material. One common form of cutter comprises a tablet, usually circular or part-circular, made up of a superhard table of polycrystalline diamond, providing the front cutting face of the cutter, bonded to a substrate which is usually of cemented tungsten carbide.

The bit body may be machined from solid metal, usually steel, or may be molded using a powder metallurgy process in which tungsten carbide power is infiltrated with a metal alloy binder in a furnace so as to form a hard matrix.

The cutters on the drill bit have cutting edges which, together, define an overall cutting profile which defines the surface shape of the bottom of the borehole which the bit drills. Preferably the cutting profile is substantially continuous over the leading face of the bit so as to form a comparatively smooth bottom hole profile.

The contribution which an individual cutter makes to the cutting action of the bit, and, in particular, to the forces acting on the bit, is subject to a number of variables. For example, such factors will vary according to the axial and radial position of each cutter relative to the other cutters. Thus, if a cutting element is radially located on the bit so that its path of movement partly overlaps the path of movement of a preceding cutter, as the bit rotates, it will be subject to lower forces than would be the case if it were radially positioned so that such overlapping did not occur, or occurred to a lesser extent, since the leading cutter will already have removed some material from the path swept by the following cutter.

Similarly, a cutter which is axially positioned so that it projects further than another similar cutter from the surface of the bit body may be subject to higher forces than said cutter. In practice the action of each cutter may be affected by the action of a number of other cutters which are at adjacent relative radial and axial positions. It will be appreciated that such cutters will not necessarily be directly adjacent one another on the actual bit body but may well be angularly displaced circumferentially from one another by a considerable distance.

In order to determine the forces acting on a particular drill bit in use, such as the effect of the cutters on weight-on-bit, torque, and any out of balance force and out of balance angle for the bit, it is desirable to be able to make an analysis of the contribution to such forces by individual cutters. This enables the force characteristics of a particular bit design to be determined and the effect of modification of the design, for example by re-positioning cutters, to be studied.

It is common practice to use computers to model and analyze bit designs and various methods of analysis have been proposed. It will be appreciated that such analysis may conveniently be carried out by constructing a computerized model or representation of a particular bit design, certain operating characteristics of the bit then being determined or estimated by a computer program which performs a series of steps on the computerized model of the bit.

The present invention sets out to provide a novel and improved method of determining characteristics of a drill bit design, and particularly for estimating the effect of cutter placement on the forces acting on the bit in use.

The method will be defined by a series of analytical steps and, for convenience and to assist understanding, such steps will be described as if being applied to physical elements. However, it will be appreciated that in practice such methods lend themselves to performance using a computer and the described steps will normally in practice be embodied in a computer program.

SUMMARY OF THE INVENTION

According to the invention there is provided a method of determining characteristics of a rotary drag-type drill bit of the kind comprising a plurality of cutters mounted on a bit body having an axis of rotation, the method comprising the steps of:

(a) creating a representation of the shapes of said cutters and their locations and orientations with respect to the bit axis;

(b) creating a plane which is fixed in relation to a selected one of said cutters;

(c) projecting on to the fixed plane the shape of said selected one of the cutters;

(d) overlaying the projection of the selected cutter with a two-dimensional array of two-dimensional cells which are smaller in area than the projection;

(e) assigning a first marker to those cells of the array which overlie the projection of the selected cutter;

(f) rotating the cutters about the bit axis until all the other cutters have passed through said plane at least once;

(g) moving the cutters axially while being rotated about the bit axis so as to represent the axial movement of the bit during drilling;

(h) projecting the shapes of said other cutters on to said plane, as they pass through the plane;

(i) assigning a second marker to those cells of the array which overlie both the projection of the selected cutter and the projections of any of the other cutters;

(j) determining one or more parameters of the region of the array which remains defined by cells having only said first marker; and (k) estimating from said parameter or parameters one or more forces which will act at the location of said selected cutter in an actual drill bit.

Said plane intersects the selected cutter and may pass through the axis of rotation of the bit.

In the case where the plane passes through the axis of rotation of the bit, the projection of the shape of the selected cutter, and the projections of the shapes of the other cutters, will usually be normal to said plane. However, methods are possible where the direction of projection is not normal to the plane, as will be described.

The two-dimensional cells may be of any shape but are preferably rectangular. For example the cells may be square.

In step (e) of the method, said second marker may be assigned to cells of the array which do not overlie the projection of the selected cutter.

In any of the methods according to the invention the cutters are moved axially while being rotated about the bit axis so as to simulate the axial movement of the bit during drilling. Preferably the cutters are rotated about the bit axis in a direction which corresponds to reverse rotation of the bit, and are moved axially in a direction which corresponds to withdrawal of the bit from a borehole being drilled.

Preferably rotation of the cutters is continued until no projection of the other cutters overlies the projection of the selected cutter as the other cutters pass through the plane.

Preferably the steps of the method are carried out for all of the cutters, each being the selected cutter in turn.

The parameters which are determined of the region of the array which remains defined by cells having only said first marker may be selected from the cut area, shear length, moments of area, and second moments of area defined by said cells. The calculation of such parameters will be described in further detail below.

Preferably the method includes the further step of combining the forces acting at the respective cutters to estimate force parameters for the drill bit as a whole. For example, said force parameters may be selected from weight-on-bit, torque, out of balance force and out of balance angle.

In some forms of analysis it may be assumed that the cutters rotate about the central axis of the bit. However, as is well known, bits are sometimes subject to "bit whirl" where the rotating bit precesses around the walls of the borehole, as the bit rotates, with the result that the central axis of the bit itself rotates about the axis of the borehole. As a result, at any instant the direction of motion of a particular cutter may not be normal to a plane passing through the central axis of the bit. In order to simulate bit whirl, therefore, the method according to the invention may be modified so that the projection of the shape of each cutter, relative to said plane, is in a direction corresponding to the direction of motion of that cutter through said plane, as modified by a prescribed motion of the bit axis.

The method according to the invention may be used in conjunction with conventional dynamic analysis techniques in order to carry out dynamic analysis of a bit design, as will be described.

DETAILED DESCRIPTION OF THE PREFERRED EMBODIMENT

The invention relates to rotary drag-type drill bits for use in drilling holes in subsurface formations and of the kind where a plurality of cutters are mounted on a bit body having an axis of rotation.

Figure 1:
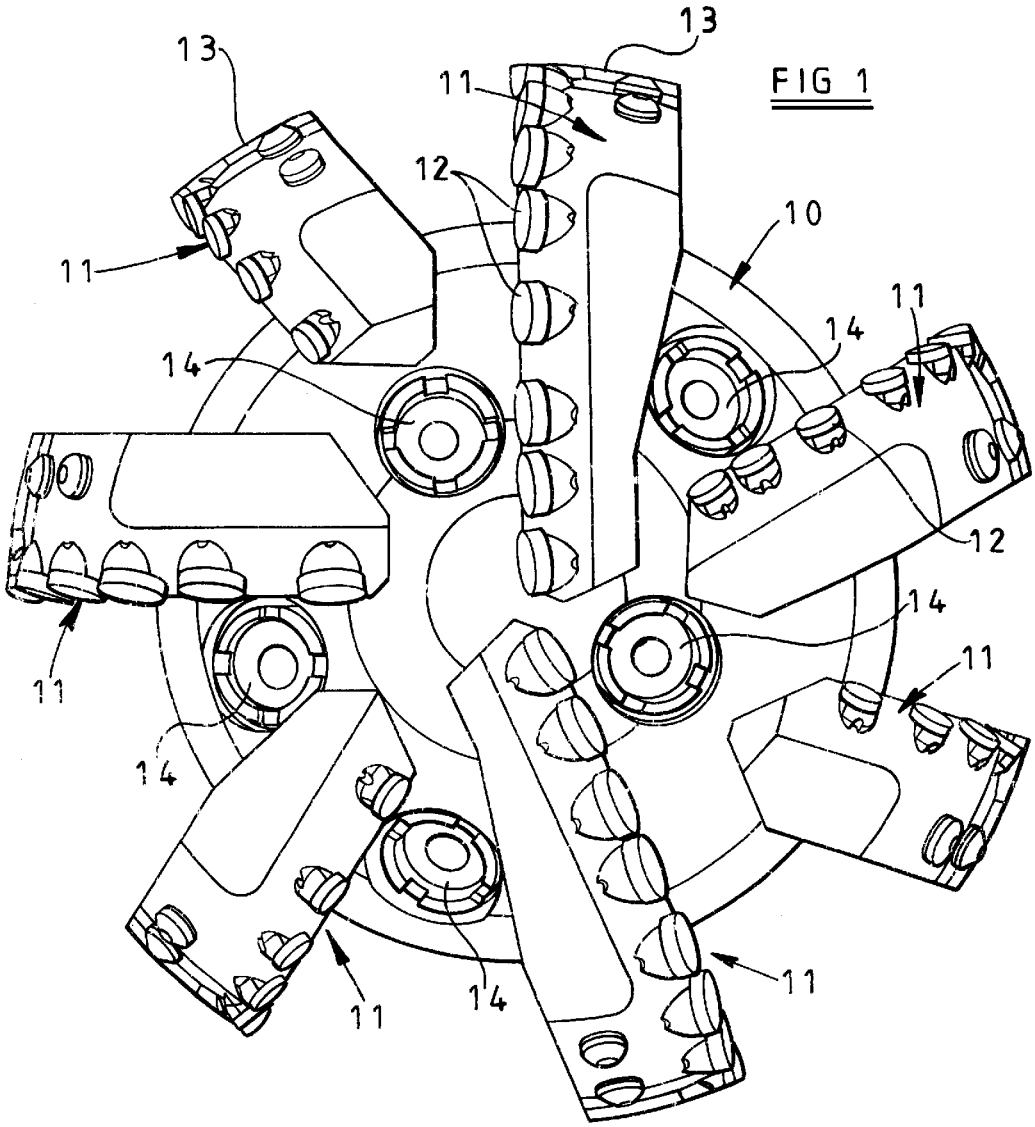
FIG. 1 is an end view of one kind of a drill bit of the general type to which the invention is applicable.
Figure 2:
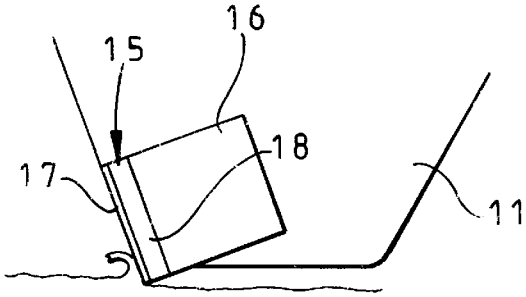
FIG. 2 is a diagrammatic section through a typical preform cutter mounted on the drill bit.

Referring to FIGS. 1 and 2, there is shown an end view of one kind of full bore drill bit of the type to which the method of the present invention may be applied. The bit body 10 is typically machined from steel and has a threaded shank (not shown) at one end for connection to the drill string. The operative end face of the bit body is formed with a number of blades 11 radiating outwardly from the central area of the bit, the blades carrying cutters 12 spaced apart along the length thereof.

The bit gauge section includes kickers 13 which contact the walls of the borehole in use, to stabilize the bit in the borehole. A central passage (not shown) in the bit body and shank delivers drilling fluid through nozzles 14 mounted in the bit body, in known manner, to clean and cool the cutters.

Each cutter 12 comprises a preform cutting element 15 mounted on a carrier 16 in the form of a stud which is secured in a socket in the blade 11. Each cutting element 15 comprises a circular tablet having a front facing table 17 of polycrystalline diamond, providing the front cutting face of the element, bonded to a substrate 18 of cemented tungsten carbide, the substrate being in turn bonded to the carrier 16.

It will be appreciated that this is only one example of many possible variations of the type of bit and cutter to which the present invention is applicable.

The object of the method according to the invention is to enable a steady state analysis of a particular design of drill bit to be carried out so as to determine the contribution made by the cutters to the forces acting on the bit in use. This is achieved by first determining the shape of the portion of each cutter which contributes to the cutting action; determining certain parameters of that portion of the cutter; using those parameters in suitable cutter force algorithms in order to estimate the forces acting at each cutter; and then combining the forces acting at each of the cutters on the drill bit to determine the total effect of the cutters on the forces acting on the bit.

The steps of one particular method according to the present invention will now be described. For the purposes of explanation and clarification, the steps of the method will be described in physical terms but in practice a suitable computer program is written to carry out computerized versions of the steps described and to perform the required analysis.

EXAMPLE OF THE METHOD

Step 1

A computerized representation of the shapes of the cutters of a proposed or existing design of drill bit is created, including the locations of the cutters and their orientations with respect to the bit axis. It is common practice to create computerized representations of drill bit designs for various purposes and there are programs available for creating such representations.

Figure 3:
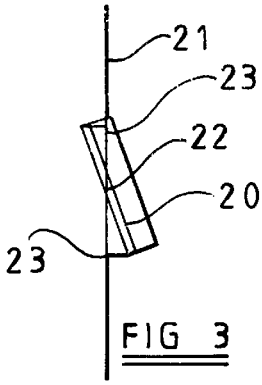
FIG. 3 shows diagrammatically the projection of the shape of the cutter on to a plane.

Step 2 (see FIG. 3)

For a selected cutter 20 a plane 21 is created which passes through the bit center axis and the center 22 of the polycrystalline diamond layer of the cutter.

Figure 4:
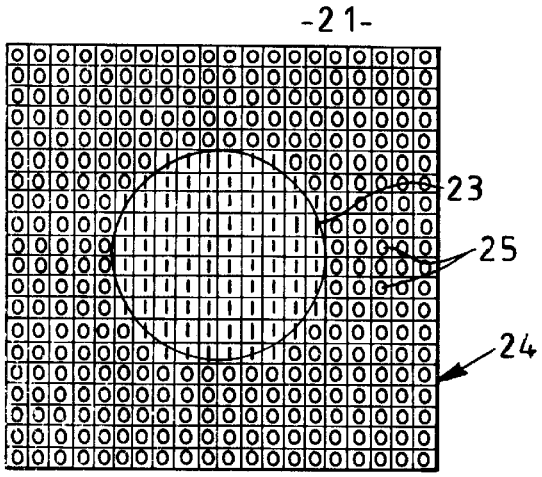
FIG. 4 is a diagrammatic representation of the projection of the shape of the cutter overlaid with an array of cells.

Step 3 (FIGS. 3 and 4)

The shape of the cutter 20 is projected normally on to the plane 21, as indicated at 23 in FIGS. 3 and 4.

The cutter will normally exhibit negative back rake, that is to say it will be inclined forwardly in the direction of rotation of the drill bit as shown in FIGS. 2 and 3, and the cutter may also exhibit side rake, that is to say it may be inclined to face inwardly or outwardly with respect to the axis of rotation of the drill bit. Accordingly, the projection 23 of the cutter on to the plane 21 will normally be an ellipse if the cutter is circular. However, for simplicity, the projections of the cutters will be shown as circular in the accompanying drawings.

Step 4 (FIG. 4)

The projection 23 of the selected cutter is overlaid with a two-dimensional array 24 comprising a large number of square cells 25 which are considerably smaller in area than the projection 23 of the selected cutter. Typically, each cell may have a side length which is about one hundredth of the diameter of the cutter. For clarity in the drawings the cells 25 are shown larger than they would normally be in practice.

Step 5

A value of 1 is assigned to all those cells 25 which lie at least partly within the projected cutter shape 23 and a value of 0 is assigned to all those cells 25 lying outside the projected cutter shape.

Step 6

The bit is rotated in reverse relative to the plane 21 so that each cutter on the bit passes in succession through the plane 21. The reverse rotation of the bit is accompanied by axial movement of the bit in a direction corresponding to withdrawal from the borehole so as to simulate the reverse of the penetration which occurs during drilling. Consequently, each cutter moves upwards in the axial direction as it moves rearwardly through the plane 21.

Figure 5:
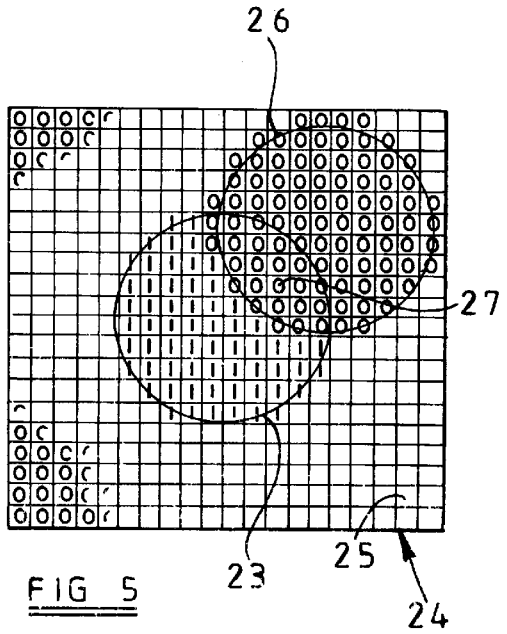
FIG. 5 shows the projection of another cutter overlaid on the array.

Step 7 (FIG. 5)

As each of the other cutters passes through the plane 21 the shape of each cutter is projected on to the array 24 as indicated at 26 in FIG. 5. FIG. 5 shows a case where the projection 26 of the other cutter partly overlies the projection 23 of the selected cutter 20.

Step 8

As indicated at 27, values of 0 are assigned to all the cells 25 which overlie both the projection 23 of the selected cutter and the projection 26 of the other cutter.

Figure 6:
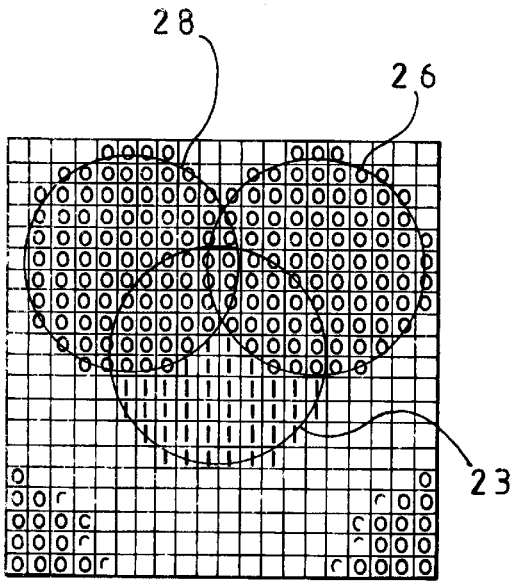
FIG. 6 shows the projection of a further cutter on the array.

Step 9 (FIG. 6)

The process is repeated for each other cutter and FIG. 6 shows the projection 28 of another cutter which projection at least partly overlies the projection 23 of the selected cutter. The reverse rotation and axial withdrawal of the bit relative to the plane 21 is continued until the projections of no more cutters interfere with the projection of the selected cutter being examined.

Figure 7:
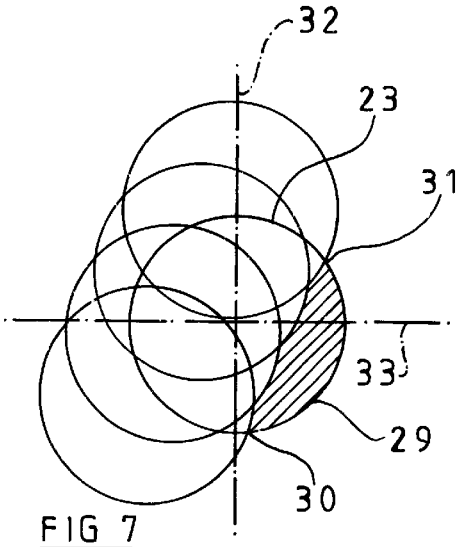
FIG. 7 is a diagrammatic representation of a cutter to illustrate certain parameters of the cutter.

As shown in FIG. 7 the cells 25 remaining with a value of 1 define the effective cutting area of the projection 23 of the selected cutter 20.

Step 10

The cut area, shear length, moments of area and second moments of area for the cells having a value of 1 are calculated for the selected cutter. These are the parameters which affect the force acting at the cutter. The cut area is the total area of the cells with a value of 1; the shear length is the length of the exposed curved cutting edge 29 of the projection of the cutter, the ends of the cutting edge being indicated at 30 and 31. The moments of area of the cells are the products of the areas of the cells and their distances from the vertical and horizontal axes 32, 33 of the projection 23. The second moments of area are the areas of the cells multiplied by the squares of the distances from these axes.

Step 11

Steps 1 to 10 are repeated for each cutter on the bit, each being the selected cutter in turn.

These steps provide the cut area properties (area, shear length etc as required) for every cutter on the bit.

Step 12

The cut area properties of the cutters are input into suitable cutter force algorithms to estimate the force acting at each cutter. Those skilled in the art will be aware of the appropriate algorithms for this purpose.

Step 13

The cutter forces of all the cutters are then combined, using conventional techniques, to determine the weight-on-bit, torque, out of balance force and out of balance angle for the bit, attributable to the cutters.

As previously explained, the above steps will normally be carried out by an appropriate computer program and the program will be arranged to provide an output of the required information in any suitable form. The program may also be arranged to provide a pictorial representation of the cut shapes provided by the cutters and the cutting profile of the drill bit.

It will be appreciated that the method, when incorporated in a computer program, may allow rapid analysis of modifications to a bit design and it may be seen readily how modifications in cutter location and orientation will affect the forces acting on the bit. It thus provides a tool whereby, for example, out of balance forces and an out of balance angle can be predetermined for a particular design of drill bit, this information being used to control bit whirl.

As previously mentioned, in order to simulate the effect of bit whirl on a particular design of bit, the method may be modified by simulating rotational precessing of the bit axis as the steps of the method proceed. This may be achieved by altering the direction of the projection of each cutter on to the array 25 so that the projection is not normal to the array but is in the actual direction of the motion of each cutter, as a result of rotation of the bit axis, as it passes through the plane of the array.

There is also the option of carrying out dynamic analyses using the above method in conjunction with conventional dynamic analysis techniques. In this case the above method requires to be slightly modified since, in dynamic analysis, the motion of the cutters is not predefined and so the cutter positions must be stored for use in subsequent "back-winding" of the bit for determination of cutter interference.

Whereas the present invention has been described in particular relation to the drawings attached hereto, it should be understood that other and further modifications, apart from those shown or suggested herein, may be made within the scope and spirit of the present invention.

What is claimed:

1. A method of determining characteristics for a design of a rotary drag-type drill comprising a plurality of cutters mounted on a bit body having an axis of rotation, the method comprising the steps of:

(a) creating a representation of the shapes of said cutters and their locations and orientations with respect to the bit axis from a desi of the drill bit;

(b) creating a plane which is fixed in relation to a selected one of said cutters;

(c) projecting on to the fixed plane the shape of said selected one of the cutters;

(d) overlaying the projection of the selected cutter with a two-dimensional array of two-dimensional cells which are smaller in area than the projection;

(e) assigning a first marker to those cells of the array which overlie the projection of the selected cutter;

(f) rotating the cutters about the bit axis until all the other cutters have passed through said plane at least once;

(g) moving the cutters axially while being rotated about the bit axis so as to represent the axial movement of the bit during drilling;

(h) projecting the shapes of said other cutters on to said plane, as they pass through the plane;

(i) assigning a second marker to those cells of the array which overlie both the projection of the selected cutter and the projections of any of the other cutters;

(j) determining one or more parameters of the region of the array which remains defined by cells having only said first marker;

(k) estimating from said parameter or parameters one or more forces which will act at the location of said selected cutter in the drill bit;

(l) repeating the steps of the method for all of the cutters, each being the selected cutter in turn, and;

(m) carrying out a steady state analysis of the design of the drill bit.

2. A method according to claim 1, wherein said plane passes through the axis of rotation of the bit.

3. A method according to claim 1, wherein said plane intersects the selected cutter.

4. A method according to claim 3, wherein the center of the selected cutter lies on said plane.

5. A method according to claim 1, wherein the projections of the shapes of the cutters are normal to said plane.

6. A method according to claim 1, wherein the two-dimensional cells of the array are rectangular.

7. A method according to claim 1, wherein, in step (e) of the method, said second marker is assigned to cells of the array which do not overlie the projection of the selected cutter.

8. A method according to claim 1, wherein the cutters are moved axially in a direction which corresponds to withdrawal of the bit from a borehole being drilled.

9. A method according to claim 1, wherein the cutters are rotated about the bit axis in a direction which corresponds to reverse rotation of the bit.

10. A method according to claim 1, wherein rotation of the cutters is continued until no projection of the other cutters overlies the projection of the selected cutter as the other cutters pass through the plane.

11. A method according to claim 1, wherein the parameters which are determined of the region of the array which remains defined by cells having only said first marker are selected from the cut area, shear length, moments of area, and second moments of area defined by said cells.

12. A method according to claim 1, including the further step of combining the forces acting at the respective cutters to estimate force parameters for the drill bit as a whole.

13. A method according to claim 12, wherein said force parameters are selected from weight-on-bit, torque, out of balance force and out of balance angle.

14. A method according to claim 1, wherein the projection of the shape of each cutter, relative to said plane, is in a direction corresponding to the direction of motion of that cutter through said plane, as modified by a prescribed motion of the bit axis.

15. A method of determining characteristics for a design of a rotary drag-type drill comprising a plurality of cutters mounted on a bit body having an axis of rotation, the method comprising the steps of:

(a) creating a representation of the shapes of said cutters and their locations and orientations with respect to the bit axis from a design of the drill bit;

(b) creating a plane which is fixed in relation to a selected one of said cutters;

(c) projecting on to the fixed plane the shape of said selected one of the cutters;

(d) overlaying the projection of the selected cutter with a two-dimensional array of two-dimensional cells which are smaller in area than the projection;

(e) assigning a first marker to those cells of the array which overlie the projection of the selected cutter;

(f) rotating the cutters about the bit axis until all the other cutters have passed through said plane at least once;

(g) moving the cutters axially while being rotated about the bit axis so as to represent the axial movement of the bit during drilling;

(h) projecting the shapes of said other cutters on to said plane, as they pass through the plane;

(i) assigning a second marker to those cells of the array which overlie both the projection of the selected cutter and the projections of any of the other cutters;

(j) determining one or more parameters of the region of the array which remains defined by cells having only said first marker;

(k) estimating from said parameter or parameters one or more forces which will act at the location of said selected cutter in the drill bit and carrying out a steady state analysis of the design of the drill bit;

wherein the cutters are moved axially in a direction which corresponds to withdrawal of the bit from a borehole being drilled.

16. A method according to claim 15, wherein said plane passes through the axis of rotation of the bit.

17. A method according to claim 15, wherein said plane intersects the selected cutter.

18. A method according to claim 17, wherein the center of the selected cutter lies on said plane.

19. A method according to claim 15, wherein the projections of the shapes of the cutters are normal to said plane.

20. A method according to claim 15, wherein the two-dimensional cells of the array are rectangular.

21. A method according to claim 15, wherein, in step (e) of the method, said second marker is assigned to cells of the array which do not overlie the projection of the selected cutter.

22. A method according to claim 15, wherein the cutters are rotated about the bit axis in a direction which corresponds to reverse rotation of the bit.

23. A method according to claim 15, wherein rotation of the cutters is continued until no projection of the other cutters overlies the projection of the selected cutter as the other cutters pass through the plane.

24. A method according to claim 15, wherein the parameters which are determined of the region of the array which remains defined by cells having only said first marker are selected from the cut area, shear length, moments of area, and second moments of area defined by said cells.

25. A method according to claim 15 including the further step of combining the forces acting at the respective cutters to estimate force parameters for the drill bit as a whole.

26. A method according to claim 25, wherein said force parameters are selected from weight-on-bit, torque, out of balance force and out of balance angle.

27. A method according to claim 15, wherein the projection of the shape of each cutter, relative to said plane, is in a direction corresponding to the direction of motion of that cutter through said plane, as modified by a prescribed motion of the bit axis.

28. A method of determining characteristics for a design of a rotary drag-type drill comprising a plurality of cutters mounted on a bit body having an axis of rotation, the method comprising the steps of:

(a) creating a representation of the shapes of said cutters and their locations and orientations with respect to the bit axis from a design of the drill bit;

(b) creating a plane which is fixed in relation to a selected one of said cutters;

(c) projecting on to the fixed plane the shape of said selected one of the cutters;

(d) overlaying the projection of the selected cutter with a two-dimensional array of two-dimensional cells which are smaller in area than the projection;

(e) assigning a first marker to those cells of the array which overlie the projection of the selected cutter;

(f) rotating the cutters about the bit axis until all the other cutters have passed through said plane at least once;

(g) moving the cutters axially while being rotated about the bit axis so as to represent the axial movement of the bit during drilling;

(h) projecting the shapes of said other cutters on to said plane, as they pass through the plane;

(i) assigning a second marker to those cells of the array which overlie both the projection of the selected cutter and the projections of any of the other cutters;

(j) determining one or more parameters of the region of the array which remains defined by cells having only said first marker;

(k) estimating from said parameter or parameters one or more forces which will act at the location of said selected cutter in the drill bit and carrying out a steady state analysis of the design of the drill bit;

wherein the cutters are rotated about the bit axis in a direction which corresponds to reverse rotation of the bit.

29. A method according to claim 28, wherein said plane passes through the axis of rotation of the bit.

30. A method according to claim 28, wherein said plane intersects the selected cutter.

31. A method according to claim 30, wherein the center of the selected cutter lies on said plane.

32. A method according to claim 28, wherein the projections of the shapes of the cutters are normal to said plane.

33. A method according to claim 28, wherein the two-dimensional cells of the array are rectangular.

34. A method according to claim 28, wherein, in step (e) of the method, said second marker is assigned to cells of the array which do not overlie the projection of the selected cutter.

35. A method according to claim 28, wherein rotation of the cutters is continued until no projection of the other cutters overlies the projection of the selected cutter as the other cutters pass through the plane.

36. A method according to claim 28, wherein the parameters which are determined of the region of the array which remains defined by cells having only said first marker are selected from the cut area, shear length, moments of area, and second moments of area defined by said cells.

37. A method according to claim 28, including the further step of combining the forces acting at the respective cutters to estimate force parameters for the drill bit as a whole.

38. A method according to claim 37, wherein said force parameters are selected from weight-on-bit, torque, out of balance force and out of balance angle.

39. A method according to claim 28, wherein the projection of the shape of each cutter, relative to said plane, is in a direction corresponding to the direction of motion of that cutter through said plane, as modified by a prescribed motion of the bit axis.

40. A method of determining characteristics for a design of a rotary drag-type drill comprising a plurality of cutters mounted on a bit body having an axis of rotation, the method comprising the steps of:

(a) creating a representation of the shapes of said cutters and their locations and orientations with respect to the bit axis from a design of the drill bit;

(b) creating a plane which is fixed in relation to a selected one of said cutters;

(c) projecting on to the fixed plane the shape of said selected one of the cutters;

(d) overlaying the projection of the selected cutter with a two-dimensional array of two-dimensional cells which are smaller in area than the projection;

(e) assigning a first marker to those cells of the array which overlie the projection of the selected cutter;

(f) rotating the cutters about the bit axis until all the other cutters have passed through said plane at least once;

(g) moving the cutters axially while being rotated about the bit axis so as to represent the axial movement of the bit during drilling;

(h) projecting the shapes of said other cutters on to said plane, as they pass through the plane;

(i) assigning a second marker to those cells of the array which overlie both the projection of the selected cutter and the projections of any of the other cutters;

(j) determining one or more parameters of the region of the array which remains defined by cells having only said first marker;

(k) estimating from said parameter or parameters one or more forces which will act at the location of said selected cutter in the drill bit and carrying out a steady state analysis of the design of the drill bit, wherein the parameters which are determined of the region of the array which remains defined by cells having only said first marker are selected from the cut area, shear length, moments of area, and second moments of area defined by said cells.

* * * * *